United States Patent [19]

Weigl

[11] 4,266,805

[45] May 12, 1981

[54] BINDING FOR CROSS COUNTRY SKIS

[75] Inventor: Erwin Weigl, Brunna.Gebirge, Austria

[73] Assignee: Polyair Produkt Design Gesellschaft m.b.h., Austria

[21] Appl. No.: 930,664

[22] Filed: Aug. 3, 1978

[30] Foreign Application Priority Data

Aug. 9, 1977 [AT] Austria ..... 5810/77

[51] Int. Cl.[3] ..... A63C 9/18

[52] U.S. Cl. ..... 280/615

[58] Field of Search ..... 280/615, 614, 635, 611, 280/613

[56] References Cited

U.S. PATENT DOCUMENTS

| | | | |
|---|---|---|---|
| 3,003,777 | 10/1961 | Hilding | 280/614 |
| 3,424,470 | 1/1969 | Voster | 280/615 |
| 4,004,823 | 1/1977 | Pyzel et al. | 280/615 |
| 4,108,467 | 8/1978 | Kreyenbuhl | 280/615 |

FOREIGN PATENT DOCUMENTS

| | | | |
|---|---|---|---|
| 496417 | 4/1930 | Fed. Rep. of Germany | 280/615 |
| 350061 | 7/1937 | Italy | 280/615 |

*Primary Examiner*—John J. Love
*Assistant Examiner*—Milton L. Smith
*Attorney, Agent, or Firm*—Scully, Scott, Murphy & Presser

[57] ABSTRACT

A binding for cross-country skis, for use with a skiing boot which has a projection that protrudes in front of the toe of the boot and is engageable with a toe iron, which is connected to the ski, wherein a pin connected to the toe iron extends through the extension when the binding is in position for use.

16 Claims, 13 Drawing Figures

BINDING FOR CROSS COUNTRY SKIS

This invention relates to a binding for cross-country skis, for use with a skiing boot which has a projection that protrudes in front of the toe of the boot and is engageable with a toe iron, which is connected to the ski, wherein a pin connected to the toe iron extends through the extension when the binding is in position for use. In the known bindings of this kind for cross-country skis, the extension consists of an extension of the sole and the toe iron connected to the ski constitutes a pocket, which corresponds to that extension in width and height. The extension of the ski boot is pushed into the toe iron from the rear. The toe iron and the extension have a transverse bore, through which a pin is inserted. A disadvantage of such known bindings for cross-country skis resides in that the pin is a separate member, which is easily lost, and that the extension is immovably held in the pocket and for this reason must be deflected during each step of the skier. The deflecting of the extension requires a certain effort and also increases the wear.

It is an object of the invention to eliminate these disadvantages. The invention resides essentially in that the toe iron comprises two checks, which engage opposite sides of the extension, which is insertable between the cheeks from above, the pin is held in the toe iron captively, the extension has at least one downwardly open groove, which extends transversely to the longitudinal direction of the boot and is adapted to receive the pin from below, and locking means are provided which oppose or prevent a movement of the extension out of the toe iron. Because the extension has a downwardly open transverse groove which is adapted to receive the pin from below and because the toe iron consists only of two cheeks, which engage opposite sides of the extension, the boot can be connected to the ski in a simple manner in that the cross-country skier places the boot from above onto the pin, which is held in the toe iron. The locking means will then hold the extension in position. The joint between the boot and ski is stressed in such a manner that only small upwardly directed forces are exerted. For this reason it will be sufficient for the locking means to oppose the movement of the extension out of the toe iron. The pin cannot be lost because it is captively held in the toe iron. The groove flares downwardly to a width which exceeds the diameter of the pin so that the placing of the boot into the toe iron can easily be accomplished and does not require a high precision.

In accordance with the invention the design is suitably such that the width of the top portion of the groove is at least as large as the thickness of the pin, the groove is constricted between its top portion and its bottom opening to a width which is smaller than the thickness of the pin, and the top portion of the groove is preferably formed as a cylindrical bore in which the pin is disposed when the binding is in position for use. Owing to this constriction of the groove the pin will snap into the top portion of the groove. This constriction in itself tends to hold the extension in the toe iron. In a preferred embodiment of the invention, the extension has on the underside a bevelled or curved surface in front of the groove, so that when the binding is in position for use the extension can be pivotally moved forwardly about the axis of the pin. In this case the pin constitutes a hinge about which the skiing boot and the extension can be pivotally moved so that the extension need not be deflected during each step of the skier. In the binding according to the invention the confronting inside surfaces of the cheek are preferably at right angles to the surfaces of the ski and parallel to each other and to the longitudinal direction of the ski so that these cheeks constitute a laterally disposed guide for the extension and the boot and the extension can be pivotally moved forwardly about the axis of the pin but is held against lateral movement as firmly as is required for cross-country skiing. In accordance with the invention, the height of the extension suitably exceeds the thickness of the sole so that the extension is properly guided between the checks of the toe iron and can take up substantial lateral forces.

In another preferred embodiment of the invention the pin is angled to form a U-shaped member, which has a free limb that is pivotally movable to a position over the extension. That free limb will then hold down the extension and act as locking means which prevent a lifting of the extension upwardly out of the toe iron even under considerable forces. The extension is suitably provided at its top with a recess and the free limb of the U-shaped member formed by the angled pin is adapted to snap into said recess in position for use. The top of the extension may comprise a ramp, which extends as far as to the recess, so that the free limb can easily be raised over said ramp and caused to snap into the recess. The pin may be angled to form an S-shaped member, in which an oppositely angled portion extends from the free limb of the U-shaped member. Such double-angled member can be engaged by a ski pole so that the free limb of the U-shaped member can be swung into the recess when it is desired to close the binding and can be lifted out of the recess when it is desired to open the binding.

In accordance with the invention, the arrangement may be such that the pin comprises a wire core and a sleeve, which surrounds the core and extends from one cheek to the other and is rotatable relative to the core. This arrangement affords two advantages. The wire core may be thinner because the pin is stiffened by the sleeve. Such core is bent in U-shape or S-shape and owing to its smaller thickness can be elastically deformed more easily so that the free limb of the U-shaped member can be more easily caused to snap into the groove.

Another advantage resides in that the rotation resulting from the pivotal movement of the extension and skiing boot now takes place between the sleeve and the core. A lubricant may be provided between the sleeve and core so that the top portion of the groove in the extension will not be worn out.

In accordance with the invention the binding may be so designed that the transverse groove in the extension extends only for part of the width of the extension and consists of two sections, which extend from the two longitudinal sides of the extension. In a particularly advantageous arrangement, each section of the groove has a downwardly flaring portion, which is defined on the inside, adjacent to the longitudinal center plane of the boot, by an inclined surface, which extends in a plane that intersects the longitudinal center plane of the boot below the sole. When such extension is inserted into a toe iron in which the retaining pin consists of a rod or wire that has been bent substantially in C shape and the free ends of the pin enter the groove, an obstruction against a movement of the extension out of the toe iron will be provided as soon as the extension has been forced down. The inner ends of the retaining pin are forced outwardly by the bevelled surfaces and as soon as the axis of the inner ends of the pin coincides with the axis of the groove the retaining pin will elastically snap into the groove. Additional locking means are not required in such case. To enable an opening of such binding, the outer edges of the cheeks of the toe iron are preferably provided with projections, which extend outwardly and force the inwardly protruding ends of the retaining pin outwardly when the retaining pin is pivotally moved. A mere pivotal movement of the retaining pin then causes the ends of the pin to move out of the groove so that the extension is released.

In numerous cases it is desired to enable an adjustment of the limit of the angular movement of the boot in dependence on individual requirements. The angular movement is limited by stop surfaces of the toe iron. To enable an adjustment of said limit, the arrangement is preferably such that the toe iron comprises a plate, which is slidable in the longitudinal direction of the ski and adapted to be fixed in position and said plate has a tapering surface which cooperates with a stop surface of the extension.

The extension is preferably provided on the underside with an elastically deformable lug, which covers the opening of the groove. This design affords the advantage that dust cannot reach the top portion of the groove and the wear is thus decreased.

Illustrative embodiments of the invention are diagrammatically shown on the drawing.

FIG. 1 is a side elevation showing the binding according to the invention for cross-country skis, FIG. 2 is a top plan view showing the embodiment of FIG. 1, FIG. 3 is a side elevation showing the toe iron, FIG. 4 is a sectional view taken on line IV—IV in FIG. 3, FIG. 5 is a sectional view taken on line V—V in FIG. 4, FIG. 6 is an elevation showing the pin for connection to the toe iron, FIG. 7 is a transverse sectional view showing a modified lower stirrup portion of such pin, FIG. 8 is a side elevation showing an extension which protrudes in front of the toe of a boot, FIG. 9 is a top plan view showing the embodiment of FIG. 8, FIG. 10 is an elevation similar to FIG. 1 and shows another embodiment of the binding according to the invention for cross-country skis, FIG. 11 is an elevation showing the binding of FIG. 10 viewed in the direction of the arrow 11, partly in a section on a plane through the toe iron.

Figure 1:
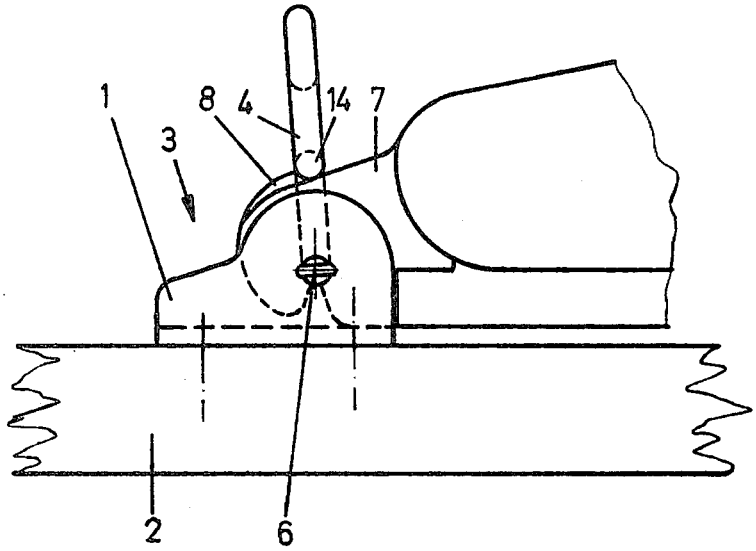
Figure 2:
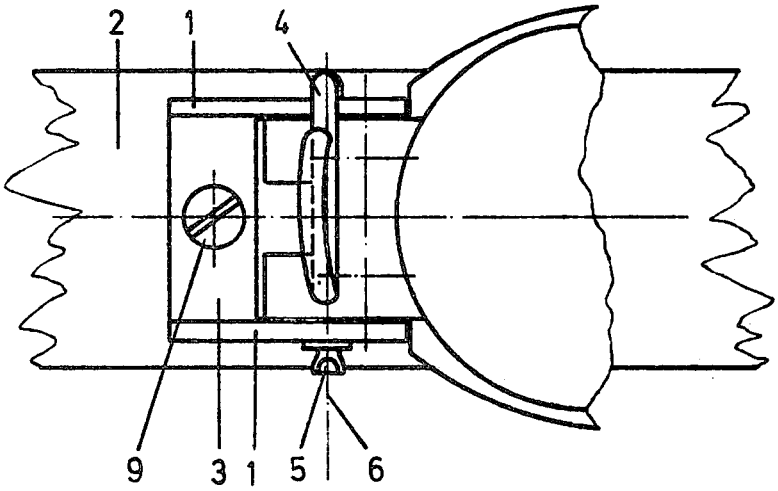

FIGS. 1 and 2 show cheeks 1 of a toe iron 3, which is connected to a ski 2. A pin 4 extends through the cheeks 1. That limb of the pin which faces the surface of the ski has an end portion which extends through the cheeks and which has been squeezed at 5 so that it cannot be pulled out. The limb of the pin 4 faces the surface of the ski and defines an axis 6. In the arrangement shown in FIGS. 1 and 2, an extension 7 has been caused to snap onto the lower limb of the pin 4 and is thus pivoted on the axis 6. The pin 4 is angled to form a U-shaped member and has been pivotally moved over a ramp 8 of the extension and caused to snap into the latter. In the embodiment shown, the toe iron 3 is fixed to the ski 2 by screws 9.

Figure 3:
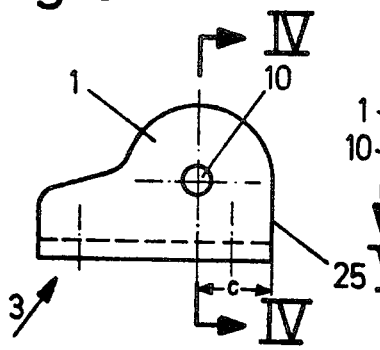
Figure 4:
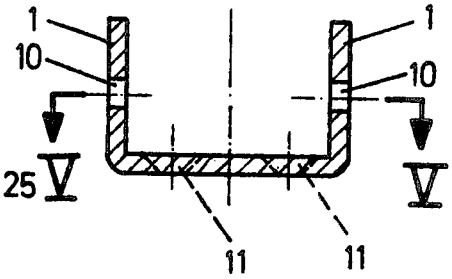
Figure 5:
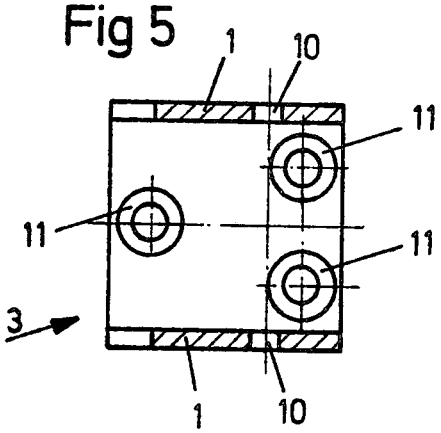

The toe iron secured to the ski is separately shown in FIGS. 3,4 and 5. The cheeks 1 of the toe iron 3 have apertures 10 for receiving the pin 4. On its side facing the ski, the toe iron has apertures 11 for receiving the screws 9. Alternatively, the toe iron 3 may be adhesively joined to the ski or embedded in the material of the ski.

Figure 6:
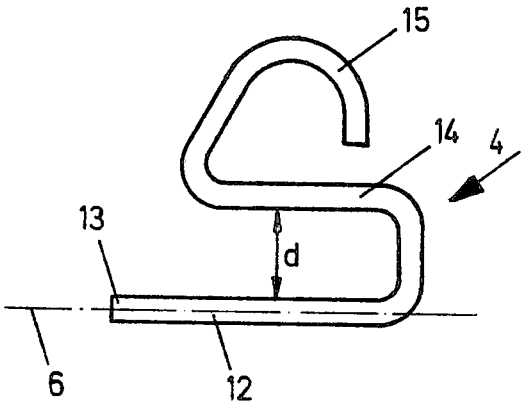

FIG. 6 shows a pin 4 which is angled to form an S-shaped member, which has a lower limb 12, which defines a pivotal axis 6 for the extension protruding in front of the toe of the boot. In FIG. 2, the free end portion 13 of the limb 12 has been inserted through the apertures 10 in the cheeks 1 of the toe iron 3 and has been deformed so that the free limb 12 cannot be pulled out of the apertures 10 in the cheeks 1. The S-shaped member 4 has a limb 14, which is parallel to the lower limb 12 and has been reversely bent therefrom to form a U-shaped member. As is apparent from FIG. 1, the limb 14 can be pivotally moved over the ramp 8 of the extension 7 to prevent an unintended separation of the extension from the pivotal axis 6 when the binding is in position for use. The pin is further reversely bent beyond the limb 14 that has been reversely bent to form a U-shaped member. As a result, the pin constitutes an S-shaped member and has an upper portion 15, which can be engaged in a simple manner by a properly shaped ski pole so that the skier while standing can pivotally move the limb 14 of the pin 4 over the ramp 8 of the extension which protrudes in front of the toe of the boot.

Figure 7:
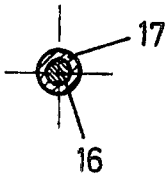

FIG. 7 is a transverse sectional view showing an embodiment of the lower limb 12 of a pin which is similar to the pin 4 shown in FIG. 6. The pin consists of a wire core 16 and a sleeve 17 fitted over said core and extending from one cheek to the other when the pin has been inserted into the toe iron 3. Such pin may comprise an elastic wire of spring steel. The sleeve 17 can rotate about the axis 6 in unison with the extension 7 so that there will be no friction and no wear in the extension 7.

Figure 8:
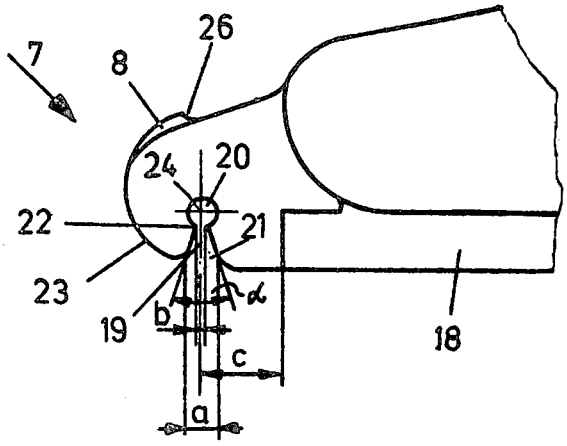
Figure 9:
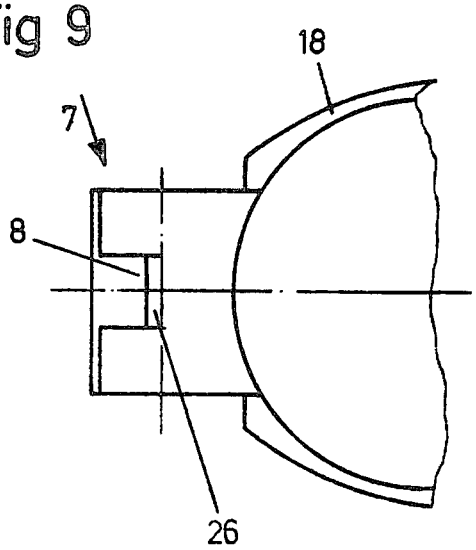

The extension which protrudes in front of the sole is shown more in detail in FIGS. 8 and 9. The extension 7 shown in FIG. 8 protrudes in front of a sole 18 of the boot and has a downwardly open groove 19, which extends transversely to the longitudinal direction of the boot. That groove flares downwardly to a width a, which exceeds the thickness of the limb 12 of the pin 4 or the outside diameter of the sleeve 17 so that the extension can be inserted in a simple manner into the toe iron 3, which is provided with the pin. The top portion 20 of the groove consists of a cylindrical bore, which has a diameter that is substantially as large as the diameter of the limb 12 of the pin 4 or the outside diameter of the sleeve 17. In position for use, the limb 12 of the pin 4 or the sleeve 17 extends in that cylindrical bore 20. Between its bottom opening 21 and its top portion formed by the cylindrical bore 20, the groove is constricted at 22 to a width b which is smaller than the thickness of the limb 12 of the pin 4 or the outside diameter of the sleeve 17. The extension consists preferably of a plastic material which has such a resilience that it permits the limb 12 of the pin 4 or the sleeve 17 to snap into the cylindrical bore 20 but substantially opposes an unintended movement of the extension out of the toe iron.

The extension 7 has on the underside a curved surface 23, which is disposed in front of the groove 19 and enables a pivotal movement of the extension 7 about the axis 6, which coincides with the axis of the cylindrical bore 20. The curvature is such that the extension 7 adjoins the plane of the sole after a predetermined angular movement and then opposes a further angular movement. The extension 7 is provided on the top with the ramp 8 which has already been described with reference to FIG. 1 and over which the limb 14 of the pin can be pivotally moved to hold the extension 7 more firmly in the position for the use of the binding. In that position the cylindrical bore 20 which constitutes the top portion of the groove engages the limb 12 of the pin or the sleeve 17. As is shown in FIG. 9, the ramp 8 does not extend throughout the width of the extension. The axis 24 of the transverse bore 20, which constitutes the top portion of the groove, coincides in the position for use with the axis 6 of the limb 12 or with the axis of the sleeve 17 and is spaced from the toe edge of the sole 18 by a distance c which corresponds to the distance c indicated in FIG. 3 between the axis of the bore and that end 25 of the cheeks 1 which is near the sole.

In the extension shown in FIG. 8, the groove tapers from its bottom opening 21 at an angle $\alpha$ of about 30° to the constriction 22 between the transverse bore 20 and the bottom opening 21 of the groove 19. With such an angle of about 30°, the extension 7 can be quickly snapped onto the limb 12 of the pin 4 or onto the sleeve 17. As has been mentioned hereinbefore, the limb 14 of the pin 4 is pivotally moved over the ramp 8 to snap into the recess 26 on the top of the extension 7 when the binding is in position for use. The distance between that recess and the axis of the cylindrical transverse bore 20 exceeds the inside distance d between the limbs 12 and 14 of the pin 4, which is thus stressed when it has snapped into the recess 26.

Figure 10:
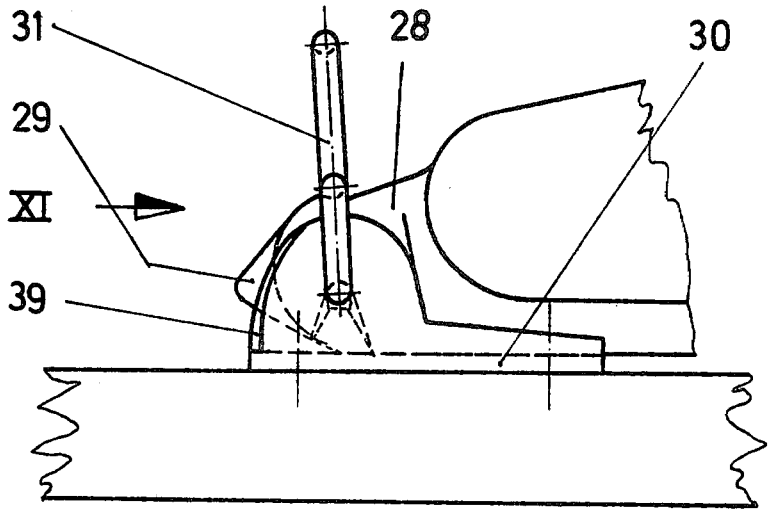
Figure 11:
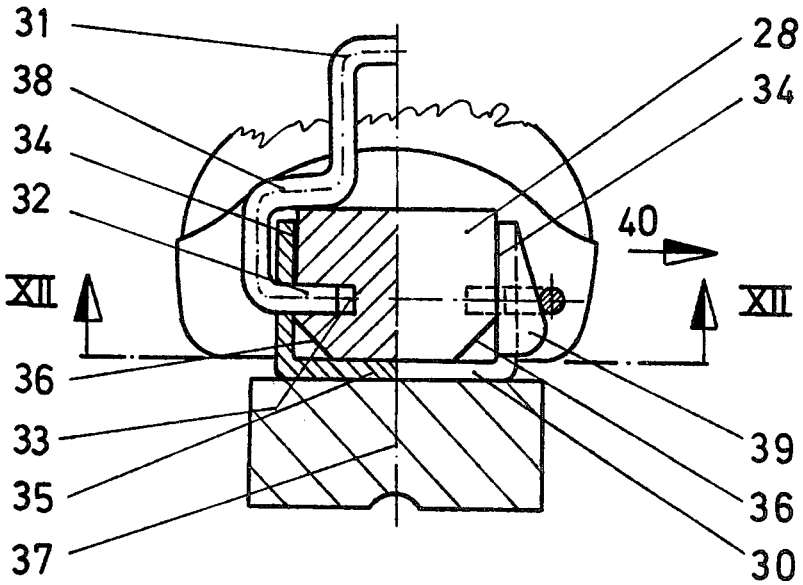
Figure 12:
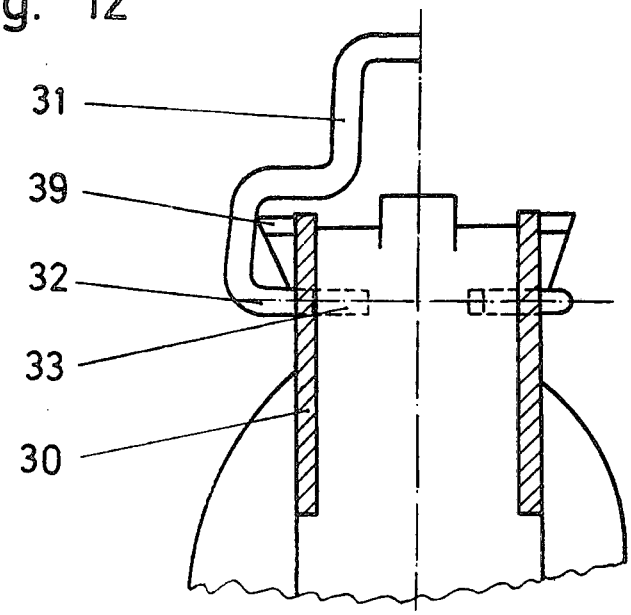
FIG. 12 is a sectional view taken on line XII—XII of FIG. 11.

In the embodiment shown in FIG. 10 the extension 28 of the boot has a stop surface 29. A retaining pin 31 extends through the toe iron 30 and, as is clearly apparent from FIG. 11, has been bent to form a substantially C-shaped member and has inwardly projecting end portions 32. The groove 33 does not extend throughout the width of the extension 28 but consists of two sections which extend from the two longitudinal sides 34 of the extension. Each of said sections of the groove 33 has a portion which flares downwardly to the plane 35 of the underside of the boot and which is defined adjacent to the longitudinal center plane 37 by an inclined surface 36, which extends in a plane that intersects the longitudinal center plane 37 at an acute angle. When the extension 28 has been inserted into the toe iron 30, the inwardly projecting end portions 32 of the retaining pin 31 can be forced outwardly as they engage the inclined surfaces 36 of the extension 28 until said end portions 32 snap into that portion of the groove 33 which is disposed above the inclined surfaces 36. In that case an additional offset portion 38 of the retaining pin 31 is not required because the extension 28 cannot move out of the groove in use in any case so that such additional locking means are not required. For this reason the additional offset portion 38 serves only to relieve the inner portion of the groove 33. The toe iron 30 is provided on its outside with projections 39, which have been formed by a reverse bending of the forward edge of the toe iron. During a forward pivotal movement of the retaining pin 31 out of the plane of the drawing, the inwardly projecting ends 32 will be forced outwardly in the direction of the arrow 40 and thus release the extension 28. These conditions are shown in FIG. 12, in which the retaining pin 31 is shown after a forward pivotal movement, during which the inwardly protruding ends 32 of the retaining pin have been moved out of the groove 33 by the projections 39.

Figure 13:
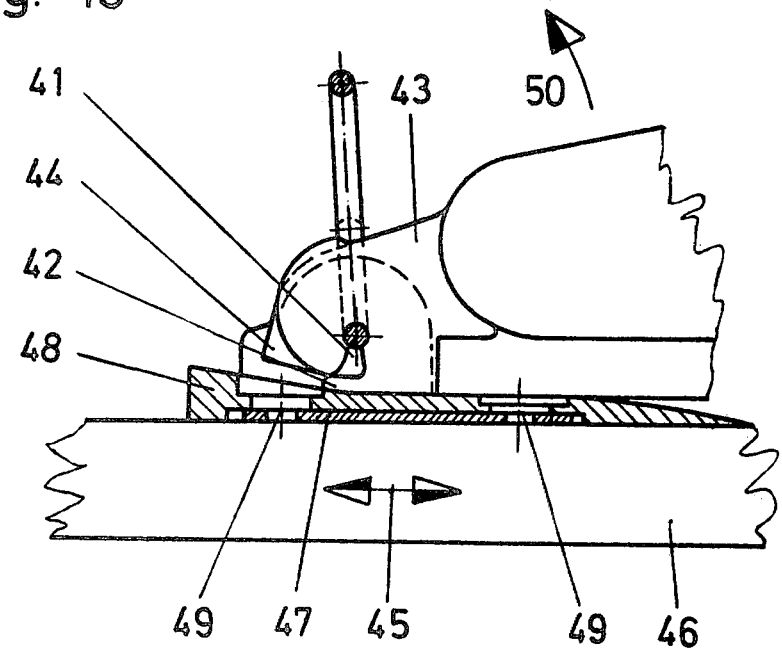
FIG. 13 is a longitudinal sectional view showing another embodiment of the binding according to the invention for cross-country skis.

FIG. 13 shows a deformable projection 42, which covers the groove 41 on the underside and prevents an ingress of dust into the groove 41. In this case, too, the extension 43 has a stop surface 44, which cooperates with a member 47, which is mounted to be slidable in the longitudinal direction 45 of the ski 46. That member 47 has a portion 48, which cooperates with the stop surface 44 and which is provided with a tapering surface. The member 47 has slots 49, which enable the member 47 to be shifted and to be fixed in the selected position. In this way the pivotal movement of the boot in the direction of the arrow 50 can be limited at desired angular positions.

What I claim is:

1. In combination, a binding for a cross-country ski and a cross-country ski boot having an extension that protrudes in front of the toe of the boot and is engageable with the binding, said binding comprising a toe iron member which is connected to the ski, comprised of two cheeks, which engage opposite sides of said boot extension; a pin connected to, and captively held in, said toe iron member, said pin extending into the boot extension when the binding is in position for use, said pin also being angled to form a U-shaped member, which has a free limb that is pivotally movable to a position over the extension, said ski boot extension being insertable between the cheeks of said toe iron member from above, said extension having at least one downwardly open groove extending transversely to the longitudinal direction of the boot, and said groove being adapted to receive the pin from below; said limb when in position over the extension forming and a locking means which opposes or prevents movement of the boot extension out of the retained position.

2. The combination, a binding and ski boot for cross-country skis according to claim 1, characterized in that the groove flares downwardly to a width which exceeds the diameter of the pin.

3. The combination, a binding and ski boot for cross-country skis according to claim 1, characterized in that the width of the top portion of the groove is at least as large as the thickness of the pin, the groove is constricted between its top portion and its bottom opening to a width which is smaller than the thickness of the pin, and the top portion of the groove is preferably formed as a cylindrical bore in which the pin is disposed when the binding is in position for use.

4. The combination, a binding and ski boot for cross-country skis according to claim 1, characterized in that the extension has on the underside a bevelled or curved surface in front of the groove and the extension is pivotally movable forwardly about the axis of the pin when the binding is in position for use.

5. The combination, a binding and ski boot for cross-country skis according to claim 1, characterized in that the height of the extension substantially exceeds the thickness of the sole.

6. In combination, a binding and ski boot for cross-country skis according to claimf 1 characterized in that the extension has at its top a recess and the free limb of the U-shaped member formed by the angled pin is adapted to snap into said recess in position for use thereby locking the ski boot securely to the skis.

7. The combination, a binding and ski boot for cross-country skis according to claim 6, characterized in that the top of the extension comprises a ramp extending as far as to the recess.

8. The combination, a binding and ski boot for cross-country skis according to claim 1, characterized in that the pin is angled to form an S-shaped member, in which an oppositely angled portion extends from the free limb of the U-chaped member.

9. The combination, a binding and ski boot for cross-country skis according to claim 1, characterized in that the pin comprises a wire core and a sleeve, which surrounds the core and extends from one cheek to the other and is rotatable relative to the core.

10. The combination, a binding and ski boot for cross-country skis according to claim 1, characterized in that the transverse groove in the extension extends only in part of the width of the extension and consists of two sections which extend from the two longitudinal sides of the extension.

11. The combination, a binding and ski boot for cross-country skis according to claim 10, characterized in that each section of the groove has a downwardly flaring portion, which is defined on the inside, adjacent to the longitudinal center plane of the boot, by an inclined surface, which extends in a plane that intersects the longitudinal surface center plane below the sole.

12. The combination, a binding and ski boot for cross-country skis according to claim 10, characterized in that the retaining pin is formed by a rod or wire with two U-shaped members which have free end portions extending into the groove.

13. The combination, a binding and ski boot for cross-country skis according to claim 12, characterized in that the cheeks of the toe iron are provided at their outer edges with outwardly protruding projections, which force the inwardly protruding end portions of the retaining pin outwardly during a pivotal movement of the retaining pin.

14. The combination, a binding and ski boot for cross-country skis according to claim 1, characterized in that the toe iron comprises a plate, which is mounted to be slidable in the longitudinal direction of the ski and can be fixed in position and which has a tapering surface which cooperates with a stop surface of the extension.

15. The combination, a binding and ski boot for cross-country skis according to claim 1, characterized in that the extension is provided on the underside with an elastically deformable lug, which covers the opening of the groove.

16. In combination, a binding for a cross-country ski and a cross-country ski boot having an extension that protrudes in front of the toe of the boot and is engageable with the binding, said binding comprising a toe iron member which is connected to the ski, comprised of two cheeks, which engage opposite sides of said boot extension; a pin connected to, and captively held in, said toe iron member, said pin extending through the boot extension when the binding is in position for use; said ski boot extension being insertable between the cheeks of said toe iron member from above, said extension having at least one downwardly open groove extending transversely to the longitudinal direction of the boot, and said groove being adapted to receive the pin from below, said extension having on its underside a bevelled or curved surface in front of the groove and being adjoined by a stop surface, which limits the forward pivotal movement of the extension, said extension also being pivotally movable forwardly about the axis of the pin when the binding is in position for use, and a locking means which opposes or prevents movement of the boot extension out of the retained position.

* * * * *